United States Patent [19]

Lau et al.

[11] Patent Number: 4,550,271

[45] Date of Patent: Oct. 29, 1985

[54] GYROMAGNETRON AMPLIFIER

[75] Inventors: Yue-Ying Lau, Silver Spring, Md.; Larry R. Barnett, Manassas, Va.

[73] Assignee: The United States of America as represented by the Secretary of the Navy, Washington, D.C.

[21] Appl. No.: 507,258

[22] Filed: Jun. 23, 1983

[51] Int. Cl.[4] ..... H01J 25/00

[52] U.S. Cl. ..... 315/4; 315/5; 315/5.13; 315/39.3; 372/2

[58] Field of Search ..... 372/2; 315/3, 4, 5, 315/5.13, 39, 39.3

[56] References Cited

U.S. PATENT DOCUMENTS

| | | | |
|---|---|---|---|
| 3,076,115 | 1/1963 | Smith | 315/39.3 |
| 3,158,779 | 11/1964 | Ayaki | 315/5.13 |
| 3,273,011 | 9/1966 | Brown | 315/34 X |
| 3,312,859 | 4/1967 | Wilbur et al. | 315/39 |
| 3,668,459 | 6/1972 | Symons et al. | 315/3.5 |
| 3,860,880 | 1/1975 | Yariv et al. | 315/4 |
| 3,887,832 | 6/1975 | Drummond et al. | 315/4 |
| 4,072,877 | 2/1978 | Davis | 315/3.5 |
| 4,143,299 | 3/1979 | Sprangle et al. | 315/5 |
| 4,225,806 | 9/1980 | Le Gardeur | 315/5 |
| 4,306,174 | 12/1981 | Mourier | 315/5 |

OTHER PUBLICATIONS

"High-Power Microwave Generation from a Rotating E Layer in a Magnetron-Type Waveguide", W. W. Destler et al., Appl. Phys. Lett., 38 (7), Apr. 1, 1981.

"Intense Microwave Generation from a Non-Neutral Rotating E Layer", W. W. Destler, et al., J. Appl. Phys., 52(4) Apr. 1981.

"Experimental Study of Microwave Generation and Suppression in a Non-Neutral E-Layer", W. W. Destler et al., Journal of Applied Physics, vol. 48, No. 8, Aug. 1977.

"Experimental Studies with the Astron Facility", R. J. Briggs et al., Proc. Conf. Plasma Phys. and Controlled Thermonuclear Reaction IAEA, Vienna (1966) vol. 2, 211-225.

"An Experimental Wide-Band Gyrotron Traveling-Wave Amplifier", IEEE Transactions on Electron Devices, vol. ED-28, No. 7, Larry R. Barnett et al.

"A High Gain Single Stage Gyrotron Traveling-Wave Amplifier", L. R. Barnett et al., IEDM (Dec. 80) Tech: Digest, pp. 314-317, Washington, D.C.

"Cyclotron Maser Instability as a Resonant Limit of Space Charge Wave", Y. Y. Lau et al., Int. J. Electronics, 1981, vol. 51, No. 4, 331-340.

"Theory of a Low Magnetic Field Gyrotron (Gyromagnetron)", International Journal of Infrared and Millimeter Waves, vol. 3, No. 5, 1982.

*Primary Examiner*—Saxfield Chatmon

*Attorney, Agent, or Firm*—Robert F. Beers; William T. Ellis

[57] ABSTRACT

A gyromagnetron amplifier for radiation at millimeter wavelengths comprising a tapered waveguide tube with longitudinally running vanes in the walls of the tube with the number of vanes chosen to coincide with a desired cyclotron harmonic frequency to be amplified. A beam of spiralling mildly relativistic electrons with an energy of 100 keV or less is directed into the small end of the tapered waveguide tube. A tapered axial magnetic field is set up within the waveguide tube with a low value appropriate to the amplification of a cyclotron harmonic frequency. An electromagnetic wave to be amplified is launched into the waveguide tube to co-propagate and be amplified by the spiralling electron beam. This device is characterized by a wide bandwidth, a low operating magnetic field, a relatively low operating beam voltage, with high power, and the capability of continuous wave operation.

12 Claims, 5 Drawing Figures

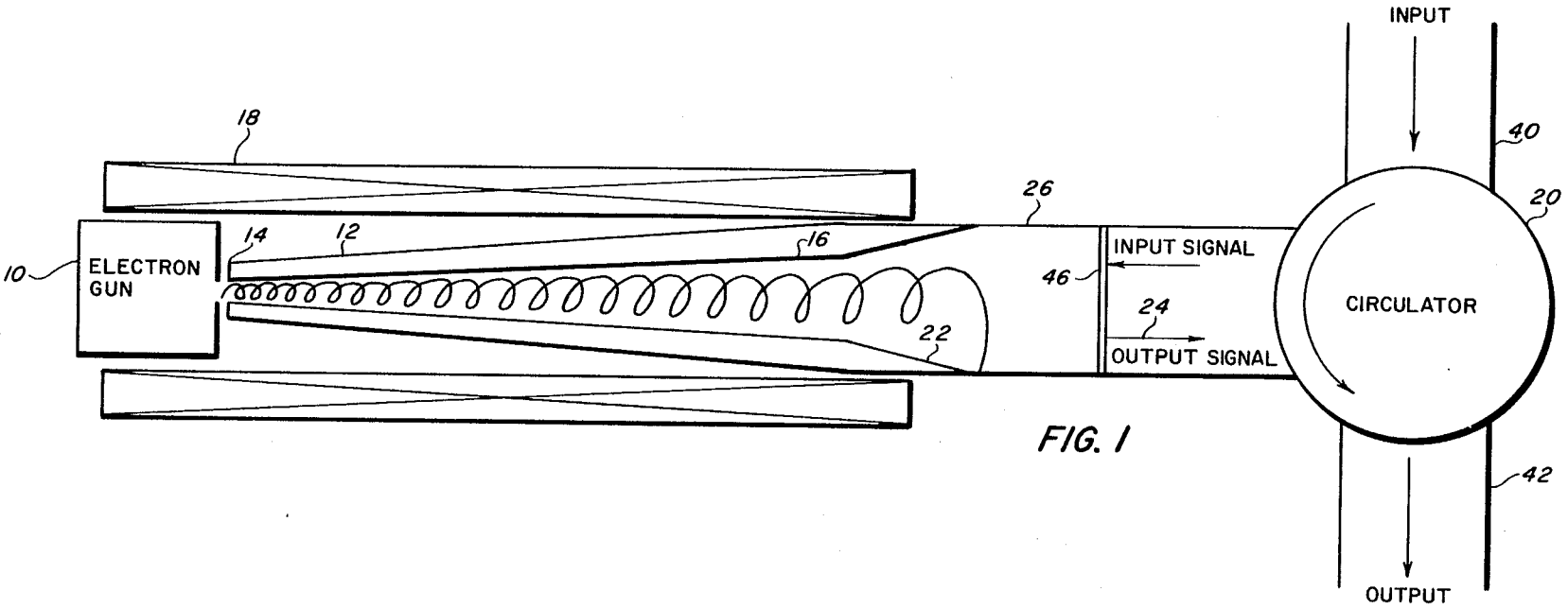
FIG. 1
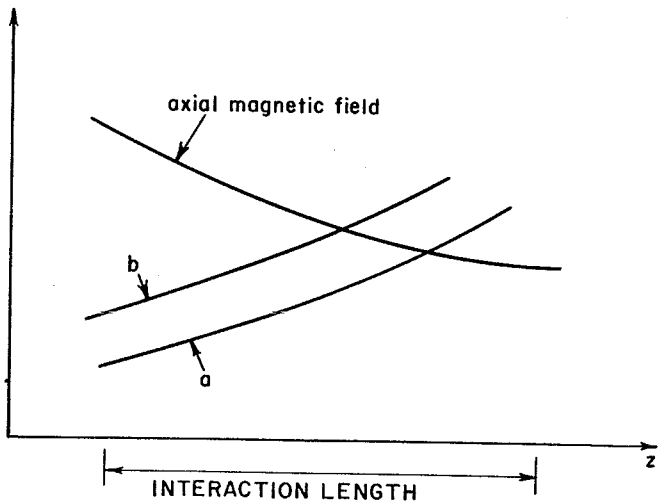
FIG. 3
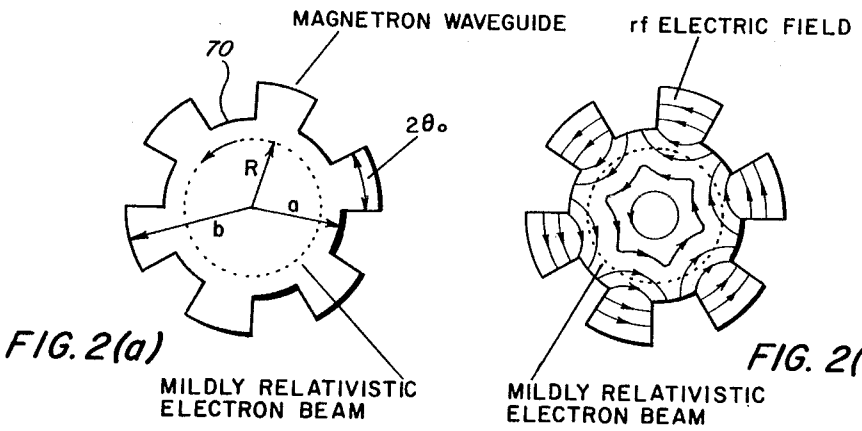
FIG. 2(a)
FIG. 2(b)

GYROMAGNETRON AMPLIFIER

BACKGROUND OF THE INVENTION

The present invention relates to generally to an efficient amplifier of millimeter wavelengths, and more particularly to a gyromagnetron amplifier which operates at a relatively low operating beam voltage and a relatively low magnetic field.

Gyrotrons (cyclotron resonance masers) have proved to be efficient high power devices in the generation and amplification of radiation at millimeter wavelengths. Most gyrotron oscillators and amplifiers operate at the fundamental cyclotron harmonic and, with a few exceptions, at the second harmonic. For a gyrotron to operate at 100 GHz at the fundamental cyclotron harmonic, a magnetic field in excess of 35 kG would be required. Such a high magnetic field can only be provided by a superconducting magnet, and is regarded as undesirable from practical considerations.

It is known that for electron devices which utilize the cyclotron resonance, the required magnetic field may be reduced by a factor of L if the device is operated at the Lth cyclotron harmonic frequency. In this regard, see the article "High Frequency Electron Discharge Device", by J. Feinstein and H. R. Jory, U.S. Pat. No. 3,457,450; and the article "Theory of Electron Cyclotron Maser Interaction in A Cavity At The Harmonic Frequencies," by K. R. Chu, Phys. Fluids, Vol. 21, pages 2354–2364, 1978. In an experiment along this line by Destler et al. described in the article "High Power Microwave Wave Generation From A Rotating E Layer In A Magnetron-type Waveguide," Applied Physics Letters, Vol. 38, pages 570–572, 1981, and the article "Intense Microwave Generations From a Non-Neutral Rotating E-Layer," Journal of Applied Physics, 52, pages 2740–2749, 1981, a waveguide wall was utilized with 12 corrugations therein so that the circuit resembled the outer boundary of a conventional or relativistic magnetron. Such a modification permitted operation at the 12th cyclotron harmonic where a sharp increase in the output power on the order of 250 MW was obtained.

It can be seen that it is extremely desirable to utilize a high cyclotron harmonic frequency in the gyrotron device in order to significantly reduce the required magnetic field. The most efficient mode of operation at the Lth cyclotron harmonic is the circular $TE_{L1}$ mode. For a high harmonic number L, the electric field for the $TE_{L1}$ mode is highly concentrated toward the wall of the waveguide. It is the general belief in the art that in order for electrons to interact strongly with the electromagnetic field of the wave to be amplified, these electrons must possess an energy far in excess of 100 keV (see U.S. Pat. No. 3,457,450 noted above) and perhaps in the MeV range as in the experiment by Destler et al. The reason for this perception in the art of a need for a high energy relativistic electron beam is that only with such a beam would the Larmor radii of the electrons be sufficiently large to couple strongly with the $Te_{L1}$ mode. However, placing a energetic electron beam very close to the waveguide wall for the device in order to couple with the $TE_{L1}$ mode is not an attractive feature because of the potential for waveguide burnout if the beam is even slightly misaligned. Additionally, operation at a high cyclotron harmonic via the propagation of a highly relativistic electron beam inside an unloaded waveguide leads to serious problems in mode competition. Finally, and most importantly the generation of such a highly energetic electron beam in the MeV range would require a device with a volume on the order of a small room. Thus, such a highly relativistic electron beam is simply not practical for standard millimeter wave device fabrication. Accordingly, it can be seen that there are significant drawbacks to the use of high cyclotron harmonic frequencies sufficient to allow the elimination of the superconducting magnet requirement.

OBJECT OF THE INVENTION

Accordingly, it is an object of the present invention to efficiently amplify millimeter wavelengths without the requirement for a highly relativistic electron beam or the need for a superconducting magnet.

It is a further object of the present invention to provide a gyromagnetron amplifier for millimeter wavelengths which operates efficiently at a high cyclotron resonant frequency and which utilizes a relatively low operating beam voltage.

It is yet a further object of the present invention to provide a millimeter wavelength amplifier which is compact in size and capable of continuous wave operation.

It is still a further object of the present invention to provide a gyromagnetron amplifier of millimeter wavelengths which operates at a high cyclotron harmonic frequency and is characterized by wide bandwidth and a relatively low operating beam voltage.

Other objects, advantages, and novel features of the present invention will become apparent from the detailed description of the invention, which follows the summary.

SUMMARY OF THE INVENTION

Briefly, the present invention comprises a method and a means for efficiently amplifying radiation at millimeter wavelengths. The device comprises a waveguide tube having longitudinally running vanes in the walls thereof, with the number of vanes coinciding with the number of the desired cyclotron harmonic frequency to be amplified, and wherein the dimensions for the tube are chosen so that the desired cyclotron harmonic frequency is approximately equal to the cut-off frequency of a fundamental mode of the waveguide tube. An approximately axial magnetic field is set up within the tube with a low value appropriate to the amplification of a cyclotron harmonic frequency. A beam of spiralling mildly relativistic electrons with a energy of 100 keV or less is directed to propagate longitudinally in the waveguide tube while interacting with the fringe electric fields set up between the vanes. The electromagnetic energy to be efficiently amplified is launched into the waveguide tube to co-propagate with the spiralling electron beam and to be amplified thereby. The use of a low power electron beam in combination with a vaned waveguide tube and a low operating magnetic field is unprecedented. Such a design for a gyromagnetron amplifier yields a device which is compact in size and thus constitutes a practical design for tube manufacture. This device is amenable to continuous-wave operation.

In a preferred embodiment, the waveguide tube is tapered longitudinally from a small first end to a larger second end. The magnetic field is also tapered along the length of the tube. This tapering feature gives the device a wide bandwidth characteristic. The spiralling electron beam is launched in the small first end to propagate within the tube toward the larger second end.

BRIEF DESCRIPTION OF THE DRAWINGS

FIG. 1 is a schematic diagram of the gyromagnetron of the present invention.

FIG. 2(*a*) is a cross-sectional view of a gyromagnetron with six vanes.

FIG. 2(*b*) is a cross-sectional view of a six vaned gyromagnetron with the rf electric fields of the $2\pi$ mode illustrated.

FIG. 3 is a graph of the waveguide wall taper and the magnetic field taper as a function of the axial position z.

FIG. 4 is a graph of the coupling constant $\epsilon$ as a function of b/a.

DETAILED DESCRIPTION OF THE PREFERRED EMBODIMENT

Figure 4:
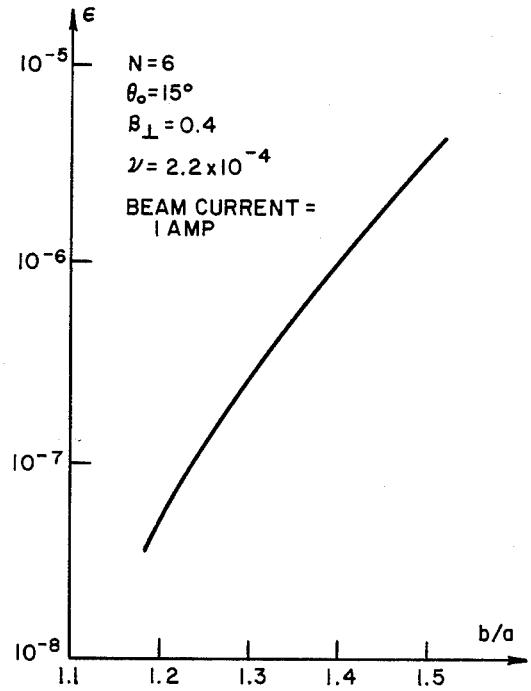

Referring now to drawings, wherein like reference characters designate like or corresponding parts throughout the views, FIG. 1 shows the gyromagnetron structure of the present invention for efficiently amplifying millimeter and submillimeter waves over a wide frequency band with a low operating beam voltage and a low operating magnetic field. The structure comprises an electron gun 10 for generating a beam of mildly relativistic electrons with substantial energy in its cyclotron motion to propagate in a waveguide tube 12. A variety of electron guns are suitable for producing a spiralling electron beam with substantial energy in its cyclotron motion. By way of example, an electron gun which uses a magnetic field reversal to achieve the desired beam geometry may be utilized. As an alternative, a Pierce gun which uses a tilted space charge limited device in conjunction with some B field compression to achieve large perpendicular electron velocities may be utilized. A third electron gun which is suitable for this application uses a kicker for providing a sharp and transverse electro-static field in conjunction with some B-field compression to achieve the proper perpendicular velocity of the electron beam. The kicker acts to "kick" the beam sideways to impose the transverse velocity. It should be noted that the present gyromagnetron design can tolerate a large velocity spread in the electron beam. Thus, a wide variety of electron guns can be utilized with the invention.

The electron gun 10 may be connected to a modulator (not shown) which supplies the required operating voltages and currents in the well known manner.

The waveguide 12 may take a variety of cross-sectional shapes. It is generally preferable though to have the center core of the waveguide where the electron beam propagates and spirals to be circular. The waveguide walls may be fabricated from standard waveguide material.

The waveguide tube 12, in an preferred embodiment, may have a gradual taper from a small first end 14 to a larger second end 16. The electron beam is introduced at the small first end 14, so that the wall radius of the waveguide tube 12 increases in the downstream direction of the electron beam. It has been found that the use of such a tapered waveguide tube yields a significant improvement in wideband operation. The rationale behind this tapering of the waveguide is that there is a minimum frequency which will propagate in a waveguide of constant cross-section. This minimum frequency for the cut-off frequency changes as the cross-section of the waveguide changes. When input waves propagate into a portion of the waveguide where those frequencies are less then the minimum frequency (their wavelength is greater then the maximum wavelength which will propagate at that point in the waveguide) then these input waves will be reflected back along the waveguide. By tapering the waveguide, i.e. by gradually changing the cross-section thereof, the minimum frequency or cut-off frequency for the waveguide will change. Thus, waves of different frequencies will be reflected from different points along the waveguide structure. Accordingly, an input wave composed of a plurality of frequencies propagating from the input coupler toward the small end 14 of the waveguide will have its different frequencies reflected at different points along the waveguide 12 as those frequencies reach the various points in the waveguide where they are equal to the waveguide minimum or cut-off frequency. These reflected waves will then co-propagate with the helically moving electron beam and will be amplified thereby. The use of the tapered waveguide thus permits a plurality of frequencies to be reflected and to co-propagate with the electron beam thereby permitting a significant improvement in wideband operation. For further details, see the article "Experimental Wideband Gyrotron Traveling-Wave Amplifier" by Barnett et al., IEEE Transactions on Electron Devices, Vol. ED-28, No. 7, July 1981 and U.S. patent application Ser. No. 389,133 filed on June 16, 1982.

A mode converter section 22 is located immediately after the large end 16 of the waveguide tube 12 (to be discussed infra). A wall section 26 is disposed after the mode converter 22 to act as an electron collector. After amplification in the tapered region the electron beam exits from the tapered portion of the waveguide 12 and is guided radially outward by divergent magnetic field lines on to the wall section 26. A window 46 is disposed in the waveguide tube 12 to maintain a vacuum in the interaction region of the waveguide.

The waveguide tube 12, or the entire system including the electron gun 10, may be disposed inside a magnetic circuit 18 for generating a magnetic field within the waveguide 12.

An input coupler 20 is required in order to couple the electromagnetic energy to be amplified into the waveguide tube 12. In the embodiment shown in FIG. 1, the input coupler 20 is disposed downstream from the electron beam entrance point beyond the wide or large cross-section opening 16. The placement of the input coupler 20 at the large second end 16 of the waveguide tube 12 results in a reverse injection into the waveguide tube of the electromagnetic energy to be amplified.

The coupler 20 may conveniently be a circulator or a directional coupler. However, the circulator has the advantage that it will separate the input and the output waves at the large end of the waveguide. In practice, an input feed waveguide 40 is connected at one side of the circulator. Typically, this feed waveguide 40 will be connected to a source of coherent electromagnetic radiation, such as a microwave oscillator. An output waveguide 42 is connected to the other side of the circulator. It should be noted that there are a variety of other configurations and schemes available for coupling the electromagnetic energy to be amplified into the waveguide tube including side-wall injection and forward injection schemes. By way of example, see U.S. patent application Ser. No. 389,132 by L. R. Barnett, entitled "Wide-Band Distributed RF Coupler" for a side-wall injection scheme.

The magnetic field generated by the magnetic circuit 18 should be tapered with a specific profile following the taper of the waveguide tube 12. The purpose of the taper is to ensure that the Lth harmonic is near the cutoff of $2\pi$ mode at every axial location in the interaction region. The required taper is set forth by the following equation $$\frac{B}{B_o} = \frac{\gamma_{zo}^2\beta_{\perp o}^2\lambda_{wo}^2}{2\lambda_w^2}\left[1+\left(1+\frac{4\lambda_w^2}{\gamma^2\gamma_{zo}^2\beta_{\perp o}^4\lambda_{wo}^2}\right)^{\frac{1}{2}}\right],$$

where $B_o$ is the axial magnetic field at the small first end $$\gamma=(1-V_\perp^2/c^2-V_z^2/c^2)^{-\frac{1}{2}}$$

$$\gamma_{zo}=(1-V_\perp^2/c^2-V_{zo}^2/c^2)^{-\frac{1}{2}}$$

$\beta_{\perp o}$ is the electron velocity perpendicular to the magnetic field at the small first end of the waveguide divided by c, $\lambda_w$ is the cutoff wavelength of said tapered waveguide, $\lambda_{wo}$ is the cutoff wavelength of the tapered waveguide at the small first end thereof, $V_\perp$ is the electron velocity perpendicular to the waveguide axis, $V_{\perp o}$ is the electron velocity perpendicular to the waveguide axis at the small first end of the waveguide;

$V_z$ is the electron velocity parallel to the waveguide axis, $V_{zo}$ is the electron velocity parallel to the waveguide axis at the small first end of the waveguide.

The grazing condition upon which this magnetic field profiling equation is based, is independent of the dimensions a and b (shown in FIG. 2) of the waveguide.

The magnetic circuit 18 for generating the axial magnetic field may assume a variety of configurations. By way of example, the magnetic field circuit disclosed in patent application Ser. No. 389,133, by Lau et al may be utilized. The disclosure of this patent application is hereby incorporated by reference into the present specification. The magnetic circuit in the Lau et al application comprises two separate magnetic circuits. The first magnetic circuit is a solenoid for generating one or more constant magnetic fields along the length of the structure including the electron gun and the waveguide 12. The second magnetic circuit is a trim circuit for tapering the axial magnetic field in the tapered region of the waveguide. Although the magnetic configuration in Ser. No. 389,133 utilizes a superconducting solenoid for the first magnetic circuit, there is no need for such a superconducting structure in the present design because of the use of the high cyclotron harmonic frequencies. The second magnetic circuit or the trim circuit may be realized by a long stack of solenoids disposed to surround and be coaxial with the tapered waveguide 12. Each solenoid may than be individually wound to tune the field to the desired tapered value. In the alternative, each solenoid may be provided with its own power supply which may be operated to energize each solenoid at the proper current to yield the desired field taper. Using either alternative, each trim solenoid may be individually tuned to realize the desired magnetic field.

As noted above, it is desirable to use a high cyclotron harmonic frequency in order to reduce the required operating magnetic field by a factor equal to the cyclotron harmonic number. By way of example, and not by way of limitation, the present design is illustrated for use with the sixth cyclotron harmonic frequency. In order to obtain significant output power at this cyclotron harmonic in conjunction with good mode selectivity, the waveguide walls of the tube 12 are corrugated as shown in FIG. 2(*a*), to include six vanes 70 protruding inwardly towards the center of the tube. In order to properly propagate the 6th cyclotron harmonic frequency, the dimensions a and b of FIG. 2(*a*) of the waveguide and the external magnetic field $B_0$ are adjusted so that the 6th cyclotron harmonic frequency of the relativistic electron is approximately equal to the cut-off frequency of the fundamental $2\pi$ mode of the magnetron waveguide in every axial location in the interaction region. A sketch of the waveguide 12 wall taper in terms of the parameters a and b and the magnetic field taper as a function of the axial position z is set forth in FIG. 3. As noted previously, the radial dimensions a and b and the magnetic field $B_0$ are tapered gradually in order to achieve wide bandwidth operation.

The vanes noted above gradually disappear in a region labeled 22 proceeding from left to right in that region. The gradual vane disappearance effects a mode conversion from the $2\pi$ mode to the $TE_{01}$ mode. The $TE_{01}$ circular mode is a desirable mode for long transmission distances, such as to an antenna.

In operation, the electron gun 10 injects a spiralling electron beam to propagate inside the corrugated waveguide tube 12 in the presence of the tapered magnetic field noted previously. The electron beam should comprise a layer of mildly relativistic electrons, rotating at the Larmor radius R, which propagate along helical trajectories inside the waveguide. Most of the electron energy resides in the cyclotron motion. An electromagnetic energy input signal in the form of $TE_{01}$ circular mode is launched from the downstream of the relativistic electron beam by means of the input coupler 20. This input signal is mode-converted to the fundamental $2\pi$ mode in mode conversion section 22 as its propagates along in the upstream direction against the flow of the electron beam. The input wave is then reflected at various points (where the individual frequencies in the wave match the gradually changing cut-off frequency along the taper of the waveguide) of the tapering waveguide 12. These reflected individual frequencies then co-propagate with the electron beam. The right handed circularly polarized component of the Lth spatial harmonic in the $2\pi$ mode induces an rf charge density on the beam mostly at the Lth cyclotron harmonic. This rf density bunching grows as a result of the cyclotron maser/negative mass effect of relativistic electrons. This growth in charge density is further reinforced as the Lth harmonic cyclotron frequency coincides with the natural frequency of the magnetron waveguide, by design. Because of this resonance, the rf charge excites a substantial response in the $2\pi$ mode, which constitutes the amplified output wave. This amplified signal is then mode-converted to the $TE_{01}°$ mode via the mode converter 22 at the downstream end of the waveguide. As noted above, because of the taper of the waveguide tube, different frequencies are reflected and thus amplified at different axial positions along a waveguide tube.

The usual 9 dB launching loss is expected to be absent in the present reflection amplifier design.

The millimeter wave amplification of the present device is achieved by means of the electron cyclotron maser mechanism. This mechanism is setup by an ensemble of monoenergetic electrons following helical trajectories around the lines of an axial magnetic field inside a waveguide structure such as a metallic tube. The physical mechanism responsible for the radiation in the device has its origin in a relativistic effect. Initially, the phases of the electrons in their cyclotron orbits are random, but phase bunching (relativistic azimuthal bunching) can occur because of the dependence of the electron cyclotron frequency on the relativistic mass ($\Omega_c = eB/\gamma mc$). Those electrons that lose energy to the wave become lighter, rotate faster, and hence, accumulate phase lead, while those electrons that gain energy from the wave become heavier, rotate slower, and accumulate phase lag. This rotating electron interaction with the wave results in phase bunching such that the electrons radiate coherently and amplify the wave. Energy transfer from the electrons to the wave is optimized when $\omega - k_z V_{z0} - s\Omega_c \geqq 0$, where $\omega$, $k_z$, $V_{z0}$, s, and $\Omega_c$, are respectively, the wave frequency, axial wave number, axial electron velocity, cyclotron harmonic number, and electron cyclotron frequency. In essence, there is an intrinsic preference for relativistic azimuthal phase bunching in the presence of an electromagnetic wave. This bunching yields a different configuration of electrons in a lower energy state. If the incident electromagnetic wave has a frequency slightly larger than $\Omega_c$ or its harmonics, than stimulated emission occurs. Since this bunching mechanism occurs in phase with the electromagnetic wave, the stimulated radiation emission from the bunching is also emitted in phase with the wave, leading to wave amplification.

It has been discovered that with the present design configuration a significantly reduced electron beam energy may be utilized to effect millimeter wave amplification. This is in direct contradiction to the prevailing view that a highly relativistic beam must be utilized in order to excite the high cyclotron harmonics. The need for only a mildly relativistic electron beam with an energy of 100 keV or less is apparently due to the unique interaction which occurs between the fringing electric fields set up between the vanes of the waveguide and the spiralling or rotating of the electron bunches propagating in the waveguide 12. This interaction can be seen from the cross-sectional view shown in FIG. 2(*b*). The electric field lines set up between the inwardly protruding vanes in the waveguide wall are shown in the figure. In essence, these electric field lines constitute the electric field for a $2\pi$ mode. The dotted circle within the waveguide represents the approximate location of the spiralling or rotating electron bunches as they propagate axially along the tube. It can be seen that these bunches will interact strongly with the fringing electric fields protruding toward the center of the waveguide 12 as these electron bunches rotate. It is theorized that this strong interaction between the fringing fields and the electron bunches significantly reduces the required electron beam energy needed for amplification. The discovery of this unique interaction has led applicants to significantly reduce the electron beam energy in direct contradistinction to prior art experiments in this field.

In essence, the vanes in the magnetron waveguide act as a slow wave structure for the cyclotron motion of the electrons. Since the energy reservoir for a gyrotron is in its electron beam cyclotron motion, a slow wave structure along the electron cyclotron motion would render the interaction more effective than the unloaded waveguide, making it possible for high harmonic operation with a relatively low energy electron beam.

An additional theory which possibly explains why a low energy electron beam can be utilized to effect efficient millimeter wave amplification is that with the corrugated configuration of FIG. 2(*a*) the rotating relativistic beam experiences a capacitive impedance. It is well known that charge bunching in a rotating relativistic beam is destabilized if the circuit impedance is capacitive at the location of the beam. Such a destabilization of the beam will increase the growth rate of the wave thereby increasing the amplification characteristic.

The present device is referred to as a gyromagnetron because the gyrotron mechanism, i.e. the cyclotron maser (negative mass) mechanism, is utilized in conjunction with a waveguide which is similar in some aspects to a magnetron.

As noted previously, the electron beam at the downstream end 16 of the waveguide tube 12 is terminated at or dumped at the collector 26 disposed on one side of the waveguide at the end thereof. The fact that the collector or electron dump is separate from the rf emitting device permits the present embodiment to operate in a continuous wave mode. Typical magnetron designs generally require the collection of the electrons emitted from a center cathode at the outer corrugated wall with the attendant heat buildup thereon. This heat buildup prevents continuous wave operation for such magnetrons.

The basic equation for the dispersion relation utilized in the present design for taking into account the axial motion of the electrons is $$(\omega - k_z V_{0z} - L\omega_o)^2(\omega^2 - k_z c^2 - \omega_c^2) \simeq -\omega_c^4 \epsilon$$

where $V_{oz}$ is the axial velocity of streaming electrons in equilibrium $k_z$ = wave number along the axial direction $= 2\pi/\lambda$axial $\omega_o$ = relativistic cyclotron frequency in radians $\omega$ = frequency in radials c = speed of light $\omega_c$ = cutoff frequency of the waveguide in radians.

L = harmonic number $\epsilon$ = coupling constant (gain increases with $\epsilon$)

For further details on the use of this equation in formulating a device design, see the article "Theory of a Low Magnetic Field Gyrotron (Gyrotron Magnetron)" by Lau and Barnett, International Journal of Infrared and Millimeter Waves, Vol. 3, No. 5, 1982. This article is hereby incorporated by reference into the present specification.

The design parameters for device operation at the sixth cyclotron harmonic are set forth below. In the example, the center frequency of the amplifier is chosen as 35 GHz. For the sixth harmonic, L = 6, and $\theta_0$, the angle between the vanes in the waveguide wall (FIG. 2(*a*)), is 15°. As noted previously, the magnetic field requirement for device operation is reduced by a factor of 6 if the device is specifically designed to operate at a fundamental mode equivalent to the sixth cyclotron harmonic. This mode will be the fundamental $2\pi$ mode.

The actual magnetic field utilized may be determined from the equation $$B_o = \frac{\omega}{L} \frac{m_o \epsilon_o \gamma_o}{|e|}.$$

Utilizing this equation for an interaction at 35 GHz with the fundamental $2\pi$ mode, a magnetic field of 2.4–2.5 kG is obtained. The choice of the electron beam energy will be determined by practical considerations. As noted previously, it is generally desired not to have a very energetic beam in order to provide a compact device. By way of example, a beam may be utilized which is only mildly relativistic ie. $\beta_\perp = 0.38$, corresponding to a perpendicular energy of 40 keV for the electrons. An electron with a 40 keV energy in a 2.4 kG magnetic field would require a Larmor radius of 0.32 centimeters. This can be calculated simply by means of the equation $R_{Larmor} = V_\perp/\omega_o$ with $\omega_o$ defined by the following equation:

$$\omega_o = \frac{|e| B_o}{m_o \epsilon_o \gamma_o}$$

$V_\perp$ is controlled by the voltage of the electron gun and is determined by the equation $E_\perp = \frac{1}{2} m V_\perp^2$.

Once the Larmor radius R is known for the beam, then an arbitrary clearance between the beams Larmor radius and the walls of the tube is set. This arbitrary clearance is set so that the beam is not so close to the wall such that a slight miss alignment would cause the beam the hit the wall, but the beam is close enough to cause the electron bunches circulating at the Larmor radius to substantially interact with the fringing electric field set up between the vanes of the waveguide tube. In the present design, the clearance is arbitrary set at 0.05 cm. Thus $a - R = 0.05$ cm. Accordingly, from this equation $a = R + 0.05$ cm $= 0.37$ cm.

The next step is to determine the value pa where $pa = \omega a/c$. In this case $pa = 2.71$. The value pa is equivalent to the desired Eigen value for the device. A table of calculated Eigen values for a cold magnetron waveguide determined for the sixth cyclotron harmonic frequency must then be searched to determine what value of the ratio b/a will yield an Eigen value of 2.71 for pa at the fundamental $2\pi$. Such a set of tables is shown on page 636 of the article "Theory of a Low Magnet Field Gyrotron (Gyrotron Magnetron)" by Lau and Barnett, noted previously. These tables were calculated using the equations 33 and 35 set forth on page 629 of this article. These tables set forth the Eigen values for the sixth harmonic and the second, third, and fourth octaves thereof in the first column ($m=0$); for the seventh harmonic and the second, third, and fourth octaves thereof in the second column ($m=1$); etc. for three different ratios of b/a. It can be seen that the required value of b/a needed to obtain an Eigen value of 2.71 is 1.4. Thus, $b = 0.52$ centimeters.

The Eigen value tables on page 636 of the above referenced Lau and Barnett article are useful also in that they demonstrate there is no mode competition with the sixth cyclotron harmonic. This can be seen by noting that all of the calculated Eigen values for the table for the ratio $b/a = 1.4$ differ substantially, i.e. by more than 10%, from the value of 2.71 which is obtained for the sixth cyclotron harmonic. Thus, it is clear that the sixth harmonic frequency does not resonate with any other higher octave frequency or any other modes.

The ratio b/a determined above should then be plugged into the graph shown in FIG. 4 to determine the coupling constant $\epsilon$ at this ratio. It can be seen that a ratio of 1.4 will yield a coupling constant on the order of the $10^{-6}$. Such a coupling constant will yield a reasonable gain.

For illustration, the parameters for a device efficiently operating at the sixth cyclotron harmonic frequency are also set forth for a different electron beam energy. For this example, the frequency of operation again is 35 GHz. However, the electron beam voltage is chosen as 70 keV and the beam current is chosen as 1 amp. The calculated magnetic field for these parameters is then 2.5 kG. The ratio of the perpendicular to the parallel velocity of the electrons is then the $V_\perp/V_\parallel = 1.5$. The calculated Larmor radius is 0.33 cm, and the a dimension is 0.46 cm, and the b dimension is 0.55 cm. The waveguide length may be 50 cm. The number of vanes again is equal to 6 with equal angular spacing therebetween. A device with these parameters yields a small signal gain of 20 dB and an output power of 2 kW.

It can be seen that the parameters of the present device may be varied in order to accommodate a wide variety of low electron beam energies. These electron beam energies may vary from 100 keV down to approximately 5 keV.

It should be noted again that the present invention is not restricted to usage at the sixth cyclotron harmonic frequency. A wide variety of harmonics may be utilized. The use of a different cyclotron harmonic would require a different number of longitudinally running vanes in the waveguide wall and different dimensions a and b for the waveguide cross-section. Additionally, if a different cyclotron harmonic is utilized, then a different mode of operation in the waveguide may be more suitable. By way of example, if the third cyclotron harmonic is utilized, then the $\pi$ mode can be utilized to good effect.

It should be reiterated that the present device can be operated conveniently in a cw mode. One of reasons for this cw operation is that the interaction circuit and the beam generation/retrieval are separate entities.

It is further reiterated that the use of superconducting magnets in the present design are avoided due to the use of high cyclotron harmonic frequencies in conjunction with waveguide tube dimensions set so that the desired cyclotron harmonic frequency approximately coincides with the cut-off frequency of a desired fundamental mode of the waveguide.

It is again reiterated that the present device design does not require a highly relativistic electron beam. Thus, the present invention yields a practical design for mass tube manufacture. This is in contradistinction to prior designs which require energies in the upper keV and MeV ranges, and thus require extremely large beam generating apparatus. The present design provides a very compact millimeter wave amplifier design.

It should further be noted that the present inventive design provides a natural mode selectivity due to the use of vanes of appropriate width and depth.

It should further be noted that the present design with its tapered waveguide and tapered magnetic field features provides wide bandwidth operation. However, if wide band operation is not required, then the taper on the waveguide tube and on the magnetic field may be eliminated. However, when these design features are eliminated there will be some loss of gain.

It should be further be noted that the present device with its reflection amplifier design essentially avoids launching loss. In essence, the device exploits the relativistic space charge bunching mechanism to provide amplification.

As noted previously, the parameters discussed above for this device are set forth by way of example only and not by limitation. Other cyclotron harmonic frequencies may be utilized as well as other frequency ranges. Likewise, the beam voltages and currents set forth may be varied.

It should further be noted that the present device may be operated as a oscillator, or a backward wave oscillator, or a klystrom amplifier where two magnetron type cavities are used.

Also it should be noted that a coaxial waveguide may be utilized in the present design. Because of the unique operational features of such a coaxial waveguide, it may be used in the present design with corrugations or vanes either in the inner or outer walls thereof, or in both walls.

To summarize the foregoing, the present design is based on the cyclotron maser instability obtained in a gyromagnetron configuration. This device provides efficient amplification of small wavelengths on the order of millimeters with a low operating magnetic field and a relativity low operating beam voltage on the order of keVs. This gyromagnetron device is capable of high power operation, is compact in size, and may be used for continuous wave operation. Because of the low operating magnetic field and the relativity low operating beam voltage, the present device can be made very compact and thus constitutes a practical design for tube fabrication.

Obviously many modifications and variations of the present invention are possible in light of the above teachings. It is therefore to be understood that within the scope of the appended claims the invention may be practiced otherwise than as specifically described.

What is claimed and desired to be secured by Letters Patent of the United States is:

1. A method for efficiently amplifying radiation at millimeter wavelengths in a gyromagnetron waveguide tube comprising the steps of:

choosing a waveguide tube with longitudinally running vanes in the walls of the tube, with the number of vanes in the tube chosen to coincide with the number of a desired cyclotron harmonic to be amplified, and wherein the dimensions for the tube cross-section are chosen so that the desired cyclotron harmonic frequency is approximately equal to the cut-off frequency of a fundamental mode of the waveguide tube;

generating a magnetic field within said waveguide tube in a direction approximately parallel to the axis of said waveguide tube with a value appropriate to the cyclotron harmonic frequency chosen for amplification;

generating and directing a beam of spiralling mildly relativistic electrons with an energy of 100 keV or less into said waveguide tube to propagate longitudinally therein and to interact with the fringe electric fields set up between the vanes; and launching electromagnetic energy to be amplified into said waveguide tube to co-propagate with the spiralling electron beam.

2. A method as defined in claim 1, wherein said waveguide tube choosing step includes the step of choosing a waveguide tube that is tapered longitudinally from a first end of small cross-section to a second end of large cross-section; and wherein said step of generating a magnetic field comprises the step of generating a tapered magnetic field following the taper of said waveguide tube.

3. A method as defined in claim 2, wherein said electron beam generating and directing step comprises the step of introducing the beam of electrons at the small first end of the waveguide tube to propagate longitudinally within the waveguide tube toward the larger second end.

4. A method as defined in claim 3, wherein said waveguide tube choosing step comprises the step of choosing a tube with six longitudinal vanes and wherein the dimensions of the tube are chosen so that the sixth cyclotron harmonic frequency is approximately equal to the cut-off frequency of a fundamental mode of the waveguide tube.

5. A method as defined in claim 1, wherein the number of vanes is greater than two.

6. A method as defined in claim 1, wherein the step of launching electromagnetic energy in said tube involves the use of a circulator for injecting the electromagnetic energy to be amplified into a larger second end of said tube to propagate toward a small first end of the tube until this electromagnetic energy is reflected at various points along the tapered waveguide tube.

7. A gyromagnetron amplifier comprising:

a longitudinally tapered waveguide tube which is tapered from a first end to a second end; said waveguide tube having longitudinally running vanes in the walls thereof, with the number of vanes coinciding with the number of the desired cyclotron harmonic to be efficiently amplified, and wherein the dimensions for the tube are chosen so that the desired cyclotron harmonic frequency is approximately equal to the cut-off frequency of a fundamental mode of the waveguide tube;

means for generating a tapered magnetic field within said waveguide tube in a direction approximately parallel to the axis of said waveguide tube with a value appropriate to the cyclotron harmonic frequency chosen for amplification;

means for generating and directing a beam of spiralling mildly relativistic electrons with an energy of 100 keV or less into the small first end of said waveguide tube to propagate longitudinally therein and to interact with the fringe electric fields set up between said vanes; and means for launching input electromagnetic energy into said waveguide tube to co-propagate with the spiralling electron beam to be efficiently amplified thereby.

8. A gyromagnetron amplifier as defined in claim 7, wherein said waveguide tube is circular in cross-section.

9. A gyromagnetron amplifier as defined in claim 7, wherein said waveguide tube has six longitudinally running vanes therein, and wherein the dimensions of the tubes are such that the sixth cyclotron harmonic frequency is approximately equal to the cut-off frequency of a fundamental mode of the waveguide tube.

10. A gyromagnetron amplifier as defined by claim 7, wherein said first end has a small cross-section and said second end has a large cross-section.

11. A gyromagnetron amplifier as defined in claim 10, wherein said launching means comprises a circulator for injecting the electromagnetic energy to be amplified into the larger second end of said waveguide tube to propagate toward said small first end until this electromagnetic energy are reflected at various points along the tapered waveguide tube for various frequency components.

12. A gyromagnetron amplifier as defined by claim 7, wherein the number of vanes is greater than two.

* * * * *